US009062434B2

(12) United States Patent
Espinasse et al.

(10) Patent No.: US 9,062,434 B2
(45) Date of Patent: Jun. 23, 2015

(54) DEVICE FOR EXTRACTING SOLID MATERIAL ON THE BED OF A BODY OF WATER, AND ASSOCIATED METHOD

(75) Inventors: Philippe Francois Espinasse, Bihorel (FR); Thomas Parenteau, Paris (FR)

(73) Assignee: TECHNIP FRANCE (FR)

( * ) Notice: Subject to any disclaimer, the term of this patent is extended or adjusted under 35 U.S.C. 154(b) by 70 days.

(21) Appl. No.: 14/113,242

(22) PCT Filed: Apr. 27, 2012

(86) PCT No.: PCT/EP2012/057800

§ 371 (c)(1),
(2), (4) Date: Oct. 22, 2013

(87) PCT Pub. No.: WO2012/146730

PCT Pub. Date: Nov. 1, 2012

(65) Prior Publication Data

US 2014/0041262 A1 Feb. 13, 2014

(30) Foreign Application Priority Data

Apr. 27, 2011 (FR) ..... 11 53590

(51) Int. Cl.
*E02F 7/00* (2006.01)
*E02F 3/90* (2006.01)
*E02F 7/06* (2006.01)

(52) U.S. Cl.
CPC ..... *E02F 7/005* (2013.01); *E02F 3/902* (2013.01); *E02F 7/065* (2013.01)

(58) Field of Classification Search
USPC ..... 37/313, 319, 320
IPC ..... E02F 3/88,3/94, 3/8858, 3/902, 7/005, E02F 7/065
See application file for complete search history.

(56) References Cited

U.S. PATENT DOCUMENTS 3,672,725 A 6/1972 Johnson
3,753,303 A * 8/1973 Holzenberger et al. ..... 37/309
(Continued)

FOREIGN PATENT DOCUMENTS

DE 29 06 315 A1 8/1980
EP 0 155 869 A1 9/1985
(Continued)

OTHER PUBLICATIONS

International Search Report dated Jun. 25, 2012 issued in corresponding International patent application No. PCT/EP2012/057800.
Chung J S: "Deep-Ocean Mining Technology Development Continuing at Slow Pace. Japan, Indonesia, India, others continue second generation of resource evaluation, recovery", Offshore, Pennwell, Tulsa, OK, US, vol. 56, No. 1, Jan. 1, 1996, pp. 56, 59-61, X13000596438.

*Primary Examiner* — Gary Hartmann
(74) *Attorney, Agent, or Firm* — Ostrolenk Faber LLP

(57) ABSTRACT

The device of the disclosure comprises an assembly (22) for collecting material on the bed (12) of a body of water (14), a riser (48) for lifting the solid material, and a pump (90) for lifting the solid material collected by the collection assembly (22) in the riser (48) towards the surface facility (26). The device also comprises a separator (42) for generating a stream having a high content of solid material and a stream having a low content of solid material, the separator (42) including a lower outlet (76) for discharging the stream with high content of solid material. The device comprises an upstream hose (40) connecting the collection assembly (22) to the separator (42), and an intermediate pipe (44) connecting the or each discharge outlet (76) of the stream with high content of solid material to the riser (48), the delivery outlet (100) of the pump being tapped into the intermediate pipe (44).

14 Claims, 7 Drawing Sheets

(56) References Cited

U.S. PATENT DOCUMENTS

| | | | | | |
|---|---|---|---|---|---|
| 3,763,580 | A | * | 10/1973 | Kuntz, Jr. | 37/321 |
| 3,967,393 | A | * | 7/1976 | Nixon | 37/321 |
| 4,055,006 | A | * | 10/1977 | Shibata | 37/314 |
| 4,232,903 | A | | 11/1980 | Welling et al. | |
| 4,685,742 | A | | 8/1987 | Moreau | |
| 5,199,767 | A | * | 4/1993 | Jimbo | 299/8 |
| 2014/0137442 | A1 | * | 5/2014 | Jones et al. | 37/307 |

FOREIGN PATENT DOCUMENTS

| | | | |
|---|---|---|---|
| FR | 2 467 283 | A1 | 4/1981 |
| WO | WO 2009/125106 | A2 | 10/2009 |

* cited by examiner

DEVICE FOR EXTRACTING SOLID MATERIAL ON THE BED OF A BODY OF WATER, AND ASSOCIATED METHOD

CROSS REFERENCE TO RELATED APPLICATIONS

The present application is a 35 U.S.C. §371 National Phase conversion of PCT/EP2012/057800, filed Apr. 27, 2012, which claims benefit of French Application No. 11 53590, filed Apr. 27, 2011, the disclosure of which is incorporated herein by reference. The PCT International Application was published in the French language.

BACKGROUND OF THE INVENTION

The present invention relates to a device for extracting solid material on the bed of a body of water, the device being of a type comprising:

an assembly for collecting material on the bed of a body of water;

a riser for lifting the solid material up towards a surface facility;

a pump capable of pumping a liquid, designed for lifting the solid material collected by the collection assembly in the riser towards the surface facility, the pump having an intake inlet and a delivery outlet.

Such a device is for example intended for use in seabed mining operations, or in seabed earth moving and earthworks in view of the installation and establishment of oil production facilities.

The solid material collected from the bed of the body of water consists for example formed of rocks and/or of sediments.

A device of the aforementioned type is known from the document FR-A-2 467 283. This device comprises a surface facility carried by a vessel and an assembly for the seabed. The seabed assembly includes an assembly for the collection of material consisting of an excavator vehicle.

In this device, the solid material collected from the bed of the body of water is conveyed to the surface by means of a pneumatic elevator system. To this end, an air pipeline is tapped into the riser for injecting air into the riser column.

The pneumatic system may be substituted by a pumping system using a pump which drives the stream of liquid loaded with solid material towards the top.

Alternatively, a discontinuous elevator system for pumping seawater has been mentioned, but is not described in detail.

The first system requires an injection of gas into the middle part of the riser. Such a system is thus not always easy to implement. It is in particular necessary to separate at the surface the gas injected into the liquid stream containing the solid material in order to recover the solid material.

The second solution requires the pumping of the collection stream containing the solid material by means of a pump.

Such a solution does not prove to be entirely satisfactory. Indeed, the passage of solid material through the pump causes premature wear and tear of the pump components that come in contact with the solid material.

It is therefore necessary to frequently replace the pump or its components, which requires operations that are complicated at depth, or even an interruption of the production process.

An object of the invention is to obtain a device that enables the collection and recovery of solid material on the bed of a body of water that is very reliable, while at the same time allowing for the continual production of material.

Another goal of the invention is to provide and convey a material having an improved flow, thereby minimising the internal wear of the pipe carrying it.

Yet another goal of the invention is to provide a pumping station for pumping the material that is easily accessible.

SUMMARY OF THE INVENTION

To this end, the object of the invention relates to a device of the aforementioned type, characterised in that the device comprises:

a separator, to be used for processing the collection stream received from the collection assembly in order to form a stream having a high content of solid material and a stream having a low content of solid material, the separator including an injection inlet for injecting the collection stream, and at least one lower discharge outlet for discharging the stream with high content of solid material;

an upstream flexible hose connecting the collection assembly to the separator;

an intermediate pipe connecting the or each discharge outlet for discharging the stream with high content of solid material and a lower section of the riser, the delivery outlet of the pump being tapped into the lower section of the riser or into the intermediate pipe.

The device according to the invention may comprise one or more of the following characteristic features, taken into consideration individually or in accordance with any technically possible combinations:

the separator comprises a support placed on the bed of the body of water or carried by the riser;

the separator comprises an upstream separation tank for separating the collection stream and at least one downstream discharge tank for discharging the stream with high content of solid material, the separator further comprising a distributor interposed between the upstream receiving tank and the downstream discharge tank, the distributor being adapted to selectively allow the passage of the stream with high content of solid material from the upstream separation tank to the downstream discharge tank;

the separator comprises at least two downstream discharge tanks, the distributor being controllable between a first configuration for the passage of the stream with high content of solid material from the upstream separation tank towards a first downstream discharge tank, and for isolation of the second downstream discharge tank, and a second configuration for the passage of the stream with high content of solid material from the separation tank towards the second downstream discharge tank, and for isolation of the first downstream discharge tank;

the distributor includes a rotary drum;

the collection assembly comprises an excavator vehicle intended to be brought into contact with the bed of the body of water so as to collect and remove the solid material on the bed of the body of water;

the collection assembly comprises a holding support for collecting the material intended to be placed on the bed of the body of water and means for collection deployable from the surface independently of the holding support;

it comprises a surface facility floating on the body of water, the riser opening into the surface facility;

the intake inlet of the pump is adapted to be connected to the body of water, the device including a filtration assembly interposed between the body of water and the intake inlet.

The invention also relates to a method for extraction of solid material on the bed of a body of water, characterised in that it comprises of the following steps:

providing a device as defined here above;

collection of the material on the bed of the body of water by means of the collection assembly;

separation of the collection stream received from the collection assembly in the separator in order to produce a stream with high content of solid material;

discharging of the stream with high content of solid material through the lower discharge outlet;

activation of the pump and injection of a liquid into a lower section of the riser or into the intermediate pipe for driving the stream with high content of solid material through the riser towards a surface facility.

BRIEF DESCRIPTION OF THE DRAWINGS

The invention will be better understood upon reading the description which follows, provided by way of example and with reference made to the accompanying drawings, in which.

DESCRIPTION OF PREFERRED EMBODIMENTS

In all of the remaining sections that follow, the terms "upstream" and "downstream" are to be generally understood in relation to the normal direction of flow of a fluid in a pipe.

Figure 1:
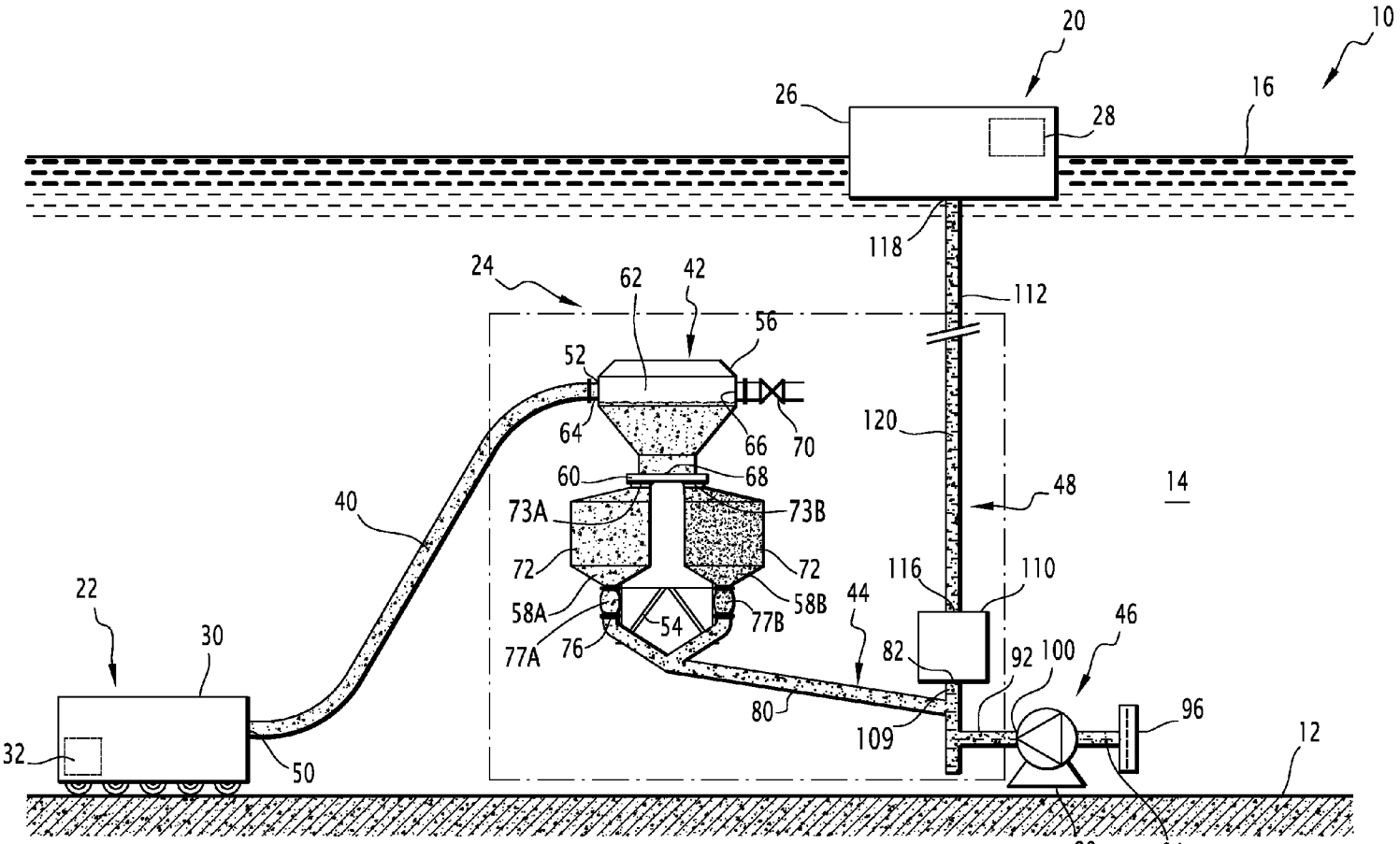
FIG. 1 is a schematic side view of the main constituent elements of a first extraction device according to the invention.

A first device 10 for extraction of the solid material on the bed 12 of a body of water 14 is illustrated in FIG. 1.

The body of water 14 is for example an ocean, a sea, a lake or a river. The depth of the body of water 14, taken into consideration between the bed 12 and the surface 16 facing the device 10 is for example between 50 meters and 5000 meters.

The body of water 14 rests on the bed 12. The bed 12 is thus defined by the solid material including the rocks and/or sediments.

The extraction device 10 is designed to be used to carry out such earth moving and excavation works on the bed 12, with a view to the establishment of an operational facility for mining minerals deposited on the bed 12, in view of the subsequent operation thereof on the surface 16 of the body of water 14. Alternatively, the device 10 is used for the installation and establishment of a hydrocarbon exploitation facility.

As shown in FIG. 1, the device 10 includes a surface assembly 20, a collection assembly 22 for collecting the material on the bed 12 of the body of water 14 and a conveyor assembly 24 for conveying the material between the collection assembly 22 and the surface assembly 20.

In this example, the surface assembly 20 is formed by a floating facility 26 such as a ship, a barge or a platform. The facility 26 is partially immersed in the body of water 14. Advantageously, the facility 26 floats on the body of water 14.

The facility 26 is for example equipped with the means 28 for unloading the solid material recovered by the conveyor assembly 24. It may include a surface separator (not shown).

In this example, the collection assembly 22 includes an excavator vehicle 30 mounted so as to be mobile on the bed 12 of the body of water 14. The excavator vehicle 30 includes autonomous means of propulsion (not shown) so as to enable it to move in an autonomous manner on the bed 12 of the body of water 14. It comprises the means 32 for collection and removal of the material, which are capable of digging, scraping, and/or drilling the material that constitutes the bed 12 and for transporting it to the conveyor assembly 24. An example of the excavator vehicle is described in French patent application FR-A-2 467 283.

The conveyor assembly 24 includes a flexible upstream hose 40, connected on to the collection assembly 22, a seabed separator 42, and an intermediate seabed pipe 44.

The conveyor assembly 24 further includes a pumping assembly 46 and a riser 48 connected to the surface facility 26.

The flexible hose 40 is sometimes referred to by the term "jumper". It is formed by a flexible pipe having an upstream end 50 connected to the collection means 32 and a downstream end 52 connected on to the separator 42.

The flexible hose 40 has a length that is greater than 100 meters and in particular between 100 meters and 200 meters. It is adapted to enable the movement of the excavator vehicle 30 around the separator 42 on the bed 12 of the body of water 14. This flexible hose 40 advantageously has a minimum bending radius before plastic deformation ("MBR" for short) of less than 1 meter.

The separator 42 is for example of the type described in the international patent application WO 2009/125106 held by the Applicant. The separator 42 comprises a support 54, an upstream upper separation tank 56 for separation of a collection stream received from the collection assembly 22 through the upstream flexible hose 40, and downstream discharge tanks 58A, 58B for the discharging of a stream with high content of solid material produced in the upstream tank 56.

The separator 42 further includes a distributor 60, interposed between the upstream tank 56 and the downstream tanks 58A, 58B for controlling the selective distribution of fluid stream with high content of solid material in the downstream tanks 58A, 58B.

Figure 2:
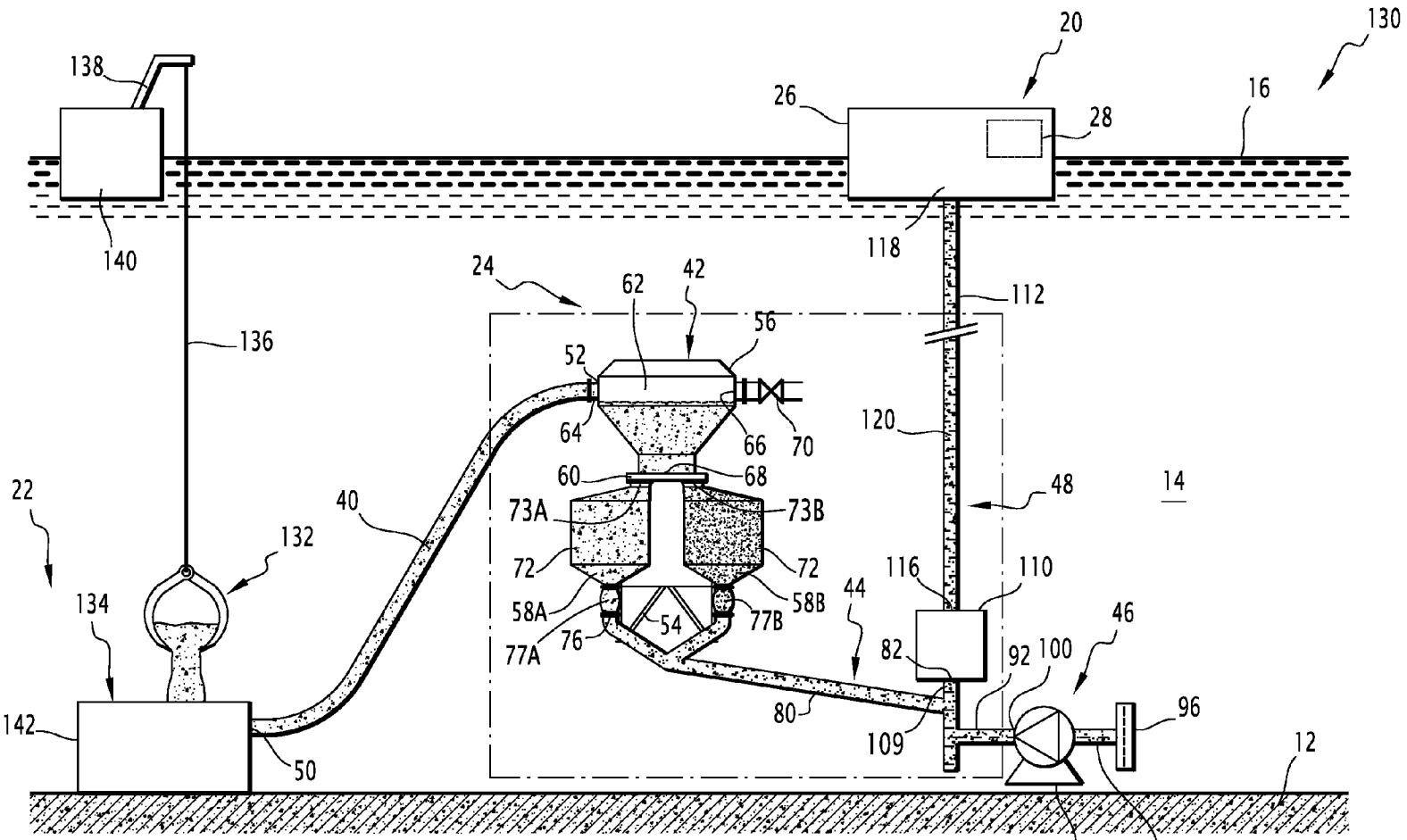
FIG. 2 is a view similar to that in FIG. 1 of a second device according to the invention.

In the assembly represented in FIGS. 1 and 2, the support 54 and the separator 42 are carried by the riser 48. In the variant in the FIG. 3, the support 54 is placed on the bed 12.

The support 54 is held immobile relative to the collection assembly 22. Thus, the collection assembly 22 is capable of moving in an autonomous and independent manner relative to the separator 42.

During the displacement of the collection assembly 22, the separator 42 remains substantially immobile relative to the bed 12 of the body of water 14.

The upstream tank 56 forms a hopper for the separation of the collection stream received from the collection assembly 22. It delineates an internal separation space 62. The internal space 62 opens out upstream through an upper opening 64 for injection of the collection stream and advantageously, through an upper outlet 66 for discharging a liquid stream with low content of solid material.

The internal space 62 in addition also opens out to the bottom through a draining outlet 68 for draining a stream with high content of solid material to the distributor 60.

The upper discharge outlet 66 for discharging the stream with low content of solid material is located above the lower draining outlet 68 for draining out the stream with high content of solid material. It is for example provided with a sealing valve 70. When the valve 70 is open, the outlet 66 opens out into the body of water. Alternatively, the outlet 66 may be connected by a pipe at the inlet of the pump 100 in order to recover the fine particles at the surface so as to further process them.

The injection inlet 64 receives the downstream end 52 of the flexible hose 40.

The draining outlet 68 is located below the injection inlet 64. It opens vertically into the bottom of the tank 56.

Thus, the collection stream containing the liquid and a solid material in divided form is suitable for being separated in the internal space 62 so as to form a stream with high content of solid material, meant to be discharged through the lower draining outlet 68, and a stream with low content of solid material meant to be discharged through the upper discharge outlet 66.

The downstream tanks 58A, 58B each define a receiving space 72 for receiving the stream with high content of solid material. For each of the downstream tanks 58A and 58B, the distributor comprises of two isolation valves 73A, 77A; 73B, 77B positioned one upstream and one downstream of the tank. The space 72 is connected upstream to the distributor 60 by an upstream inlet 74 and is connected downstream to the intermediate pipe 44 by a discharge outlet 76.

The upstream inlet 74 opens up into the distributor 60. As it will be shown here below, it is capable of being selectively connected to the internal space 62 through the distributor 60.

Each downstream outlet 76 opens out downwards to the bottom of the downstream tank 58A, 58B. It is connected to the intermediate pipe 44 by means of the downstream valves 77A, 77B.

The distributor 60 is capable of controlling the selective discharge of the stream with high content of solid material towards one of the tanks 58A, 58B by preventing the solid material from being conveyed to the other of the tanks 58B, 58A. The upstream valves 73A, 73B and the downstream valves 77A, 77B of the downstream tanks 58A and 58B are used to isolate the downstream tanks 58A and 58B selectively.

Thus, the distributor 60 may be actuated between a first distribution configuration and a second distribution configuration. In the first configuration, the internal space 62 of the upstream tank 56 is hydraulically connected to the internal space 72 of a first tank 58A. The internal space 62 of the upstream tank 56 and the internal space 72 of a second tank 58B are isolated from each other by at least one wall preventing the passage of the stream with high content of solid material.

In the second configuration, the internal space 62 of the upstream tank 56 is hydraulically connected to the internal space 72 of the second tank 58B and the internal space 62 of the upstream tank 56 is isolated from the internal space 72 of the first downstream tank 58A by a wall that prevents the passage of the stream with high content of solid material.

The distributor 60 is for example formed by a drum assembly as described in the patent application WO 2009/125106 of the applicant, and will not be described in detail herein.

The intermediate seabed pipe 44 connects each discharge outlet 76 of the separator 42 to the riser 48. It is for example formed by a rigid tube 80.

Preferably, the intermediate seabed pipe 44 connects the discharge outlets of the downstream tanks 58A and 58B to a point of the riser 48 located substantially at the bottom of the riser 48.

The downstream tanks 58A and 58B thus happen to be located at a water depth that is substantially lesser than that of the tapping point of the pipe 44 on the riser 48. Thus, the stream with high content of solid material flows due to gravity through the intermediate seabed pipe 44 until its entry into the riser.

According to the invention, the pumping assembly 46 includes a water pump 90 and an upstream tapping 92 for connecting to the intermediate pipe 44. It also advantageously comprises a connecting pipe 94 and a filter 96.

The pump 90 is for example of the diaphragm pump type.

The injection flow rate of the pump 90 is for example greater than 5000 liters per minute and in particular between 5000 liters per minute and 20000 liters per minute.

The pump 90 is capable of drawing the water present in the body of water 14 in order for conveying it from an intake inlet to a delivery outlet 100 in order to inject it under pressure into the intermediate pipe 44. The fluid pumped by the pump 90 is substantially lacking in solid material. To this end, it only contains solid materials having particle sizes of less than 5 mm.

The upstream tapping 92 connects the delivery outlet 100 of the pump 90 to a lower section 109 of the riser 48. It opens out for example transversely in the section 109 upstream of the tapping point of the pipe 44, at a distance from the discharge outlets 76 and the downstream end 82.

Advantageously, the tapping 92 opens out transversely relative to a local longitudinal axis of the riser 48.

The upstream tapping 92 is for example formed by a section of rigid tube, having a diameter that is less than or equal to the diameter of the riser 112.

The riser 48 further includes the lower section 109, a base station 110 and a riser pipe 112 connecting the base station 110 to the surface facility 26.

The intermediate pipe 44 and the pumping assembly 46 open out transversely in the lower section 109, upstream of the base station 110 under the station 110.

The base station 110 includes a connector connecting the downstream end 82 of the lower section 109 to the riser pipe 112. More generally, the base station 110 may carry various items of equipment such as the means for controlling or for supplying electrical power to the collection assembly 22, or the means for temporary storage of the solid material and the assembly 42.

The base station 110 is disposed above the bed 12 of the body of water 14, for example a few meters above the bed 12 of the body of water. The base station 110 is advantageously anchored in the bed of the body of water. It is lowered to face the bed 12 of the body of water 14 and serves to anchor the riser 112.

Once connected to the intermediate pipe 44, the base station 110 is advantageously carried by the riser 112.

The riser pipe 112 extends vertically in the water 14 extended between a lower end 116 and an upper end 118.

The lower end 116 supports the base station 110. It is hydraulically connected to the intermediate pipe 44. The upper end 118 is located on the surface facility 26. It is hydraulically connected to the unloading means 28 on the surface facility 26.

The riser pipe 112 delineates between the lower end 116 and the upper end 118, an inner passage 120 for circulation of the stream with high content of solid material. The length of the riser pipe 112 is substantially greater than the depth of the body of water 14 in order to allow the relative movements between the surface facility 20 and the station 110.

In the embodiment shown in FIGS. 1 and 2, the separator 42 is carried by the base station 110 with the pump 90 without connection to the ground in the event where the riser 48 is supported by the surface facility 20.

Figure 3:
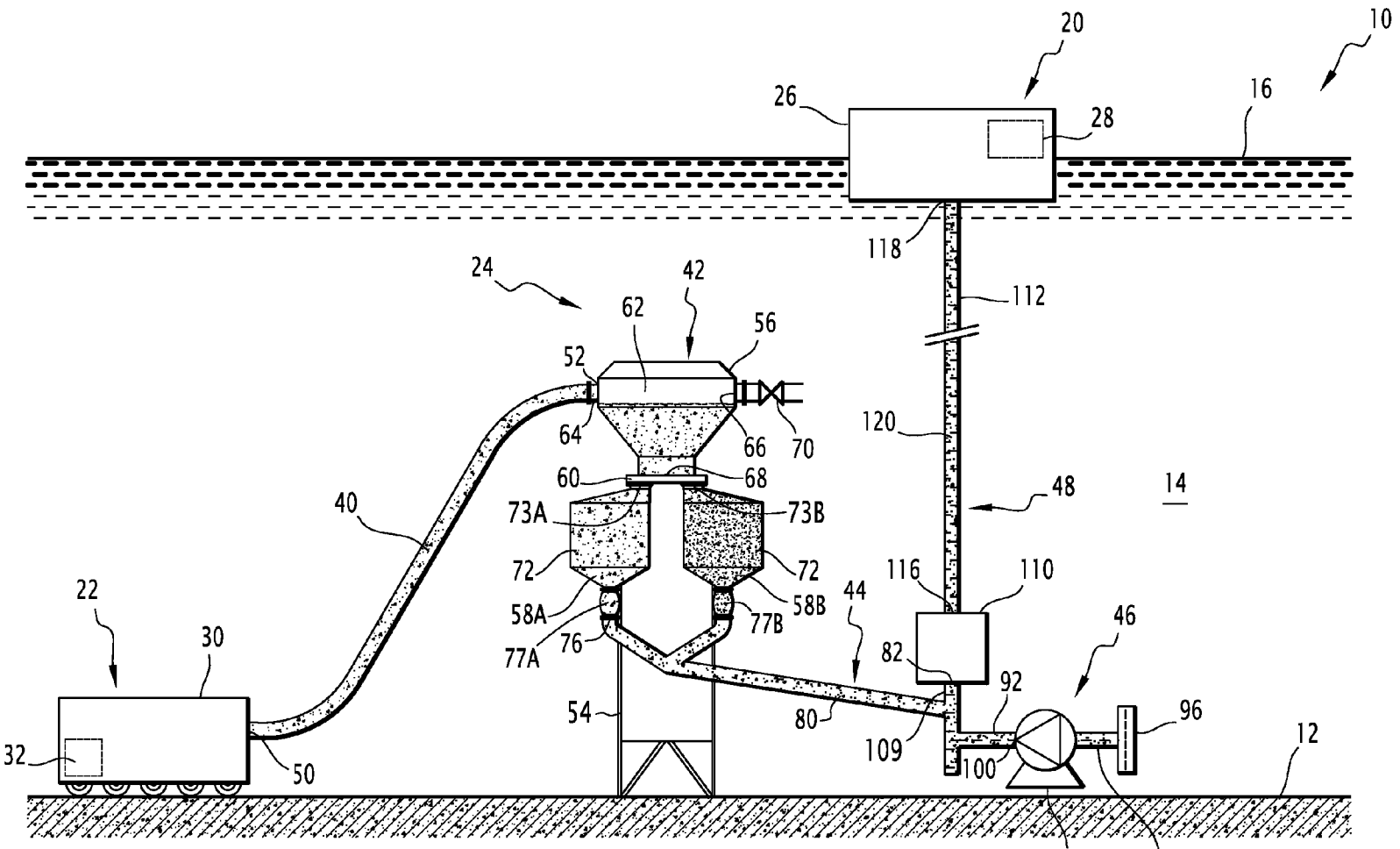
FIG. 3 is a view similar to that in FIG. 1 of a third device according to the invention.

By way of a variant, as shown in FIG. 3, the separator 42 is carried by a support 54 disposed against the bed 12.

In one embodiment, the fabrication of the riser pipe 112 is based on a rigid pipe. In this case, the rigid pipe is formed by an assembly of rigid tubular sections welded and fixed to each other.

By way of a variant, the riser 112 is formed by a pipe that is flexible over its entire length. The flexible pipe is then able to be wound and unwound from a drum or basket present on a pipelay vessel.

When the device 10 is set in place, a continuous fluid pathway extends between the collection assembly 22, through the conveyor assembly 24 up until the surface facility 26.

In particular, the continuous fluid path extends from the collection means 32 through the upstream flexible hose 40, the separator 42, the intermediate pipe 44, the lower section 109, the base station 110 and the riser 112.

The operation of the first extraction device 10 according to the invention will now be described.

Initially, the extraction device 10 is set up in place. The collection assembly 22 is lowered to the bed 12 of the body of water 14, along with the separator 42. The separator 42 is placed on the bed 12 of the body of water 14 by the base 54 and is connected to the collection assembly 22 by means of the flexible hose 40.

The intermediate pipe 44 is mounted under the separator 42.

In a variant, the separator 42 is lowered by the column 48, during the process of being assembled.

The riser 112 is deployed in the body of water bearing the lower section 109 and the base station 110 at its lower end 116. The riser 112 is then deployed to extend vertically in the body of water 14 until the base station 110 is situated close to the bed 12 of the body of water 14.

The pumping assembly 46 is then connected to the lower section 109.

The intermediate pipe 44 is also mounted on to the lower section 109 under the pump assembly 46.

When the solid material is to be collected from the bed 12 of the body of water 14, the collection assembly 22 is activated. The operation of the collection means 32 is then started in order to collect the rocks and/or sediments from the bed 12 of the body of water 14. This makes it possible to carry out earth moving and excavation operations or the recovery of solid material on the bed 12.

The material collected is then conveyed on to the separator 42 through the upstream flexible hose 40. To this end, a collection stream containing liquid and solid material in dispersed form travels through the upstream flexible hose 40. This material enters into the internal space 62 delineated by the upstream tank 56 through the injection inlet 64.

Within the internal space 62, the collection stream is separated by means of sedimentation, into a lower stream with relatively high content of solid material, collected in the bottom of the tank 56 and an upper stream with relatively low content of solid material, formed in the upper portion of the tank 56.

Advantageously, the stream with low content of solid material contains particles having a size of less than 5 mm. The distributor 60 is in its first configuration. This solid material present in the stream with high content of solid material passes into the first tank 58A. The passage of the solid material into the second tank 58B is prevented by the distributor 60.

The downstream valve 77A present at the discharge outlet 76 of the first tank 58A is then closed while the upstream valve 73A is opened. The solid material is accumulated in the internal space 72 of the first tank 58A.

In this first configuration, the internal space 62, the interior of the pipe 40, and the internal space 72 of the first tank 58A are maintained at equivalent pressure. This pressure is equal to the surrounding hydrostatic pressure (for example 200 bars). When the internal space 72 of the first tank 58A is substantially filled with solid material, the upstream valve 73A of the first tank 58A is closed, the upstream valve 73B of the second tank 58B is opened and the distributor 60 is switched into its second configuration.

In this configuration, the stream of solid material continuously collected in the upstream tank 56 is discharged into the second discharge tank 58B. The passing of the solid material into the first tank 58A is prevented by the upstream valve 73A of the first downstream tank 58A.

Simultaneously, the valve 77A located at the downstream outlet 76 for discharging fluid from the first tank 58A is opened. The pressure in the internal space 72 of the first tank 58A is then brought to the level of the pressure in the pipes 44 and 92 (for example 250 bars). The solid material present in the internal space 72 of the first tank 58A is then free to flow by virtue of gravity through the intermediate pipe 44.

The preceding steps of switching of the distributor 60 are then repeated throughout the entire process of extraction of the solid material.

Simultaneously, the pump 90 is activated in continuous mode. As a result, a flow of water drawn from the body of water 14 is pumped, through the connection pipe 94, the intake inlet 98 and the delivery outlet 100 through to the downstream tapping 92. The pressurised water is thus injected transversely into the lower section 109 so as to move up to the riser 48.

This injection of pressurised water causes the continuous driving of the stream with high content of solid material from the tank 58A, 58B through the intermediate pipe 44, the lower section 109 and right until the base station 110, and then through the internal passage 120 of the riser 112.

The fluid rich in solid material then moves up to the surface facility 26 so as to be collected in the means for loading 28.

The energy necessary for the driving of the solid material from the seabed towards the surface is provided mainly between the outlet of the separator 42 and the recovery means 28 at the surface by the injection of pressurised water into the intermediate pipe 44, upstream of the riser 48.

This injection is thus effective, since it is carried out in a concentrated stream of solid material coming from the separator 42, and in a lower section of the riser 48.

In addition, the pump 90 does not pump the solid material. Thus the wear and tear on it is significantly decreased, which improves the reliability of the extraction of solid material and avoids the need for frequent interventions.

The reliability of the pump 90 is further increased when a filter 96 is mounted upstream of the pump 90.

The separator 42 disposed on the bed 12 of the body of water 14 presents the advantage of isolating the chambers 58A and 58B which are alternately placed in communication with the exterior (filling), and then with the riser 48.

A second device 130 according to the invention is illustrated in FIG. 2. Unlike the first device 10, the collection assembly 22 includes a collection tool 132 that may be actuated from the surface 16 of the body of water 14 and the receiving means 134 resting on the bed 12 of the body of water 14 to collect the material removed by the collection tool 132.

The collection tool 132 is connected to the surface by means of an actuating cable 136 which is controlled by a crane 138 carried by a surface vessel 140.

The collection tool 132 is for example a collection gripper and/or a pneumatic drill integrally attached to the gripper, or even a pneumatic drill deployed from the vessel 140 by an additional cable for deployment and movement.

The receiving means 134 comprise an adjustable holding support 142 advantageously provided with a grinder/crusher and a funnel for receiving the collected material.

The collection tool 132 is movable relative to the holding support 142 between a position for collection of material, in contact with the bed 12 of the body of water 14, and a position for discharging the material into the holding support 142.

The flexible hose 40 is connected to the holding support 142 in order to collect the material deposited in the holding support 142.

The operation of the second device 130 according to the invention differs from the operation of the first device 10 according to the invention in that the collection tool 132 is manoeuvred from the surface by means of the cable 136 between its collection position and its discharge position. The material collected by the tool 132 is then discharged into the holding support 142 before being conveyed to the separator 42 through the flexible upstream hose 40.

The operation of the second device 130 is moreover similar to that of the first device 10.

Although the invention has been described for the extraction of minerals, it could be used for applications on land for the extraction of sludge or where the same problems of wear and tear on pumps are encountered.

In a variant (not shown) of the device 130 illustrated in FIG. 2, the collection assembly 22 includes both an excavator vehicle 30 mounted so as to be mobile on the bed 12 of the body of water 14, as well as a collection tool 132 that may be actuated from the surface 16 of the body of water and 14 the receiving means 134 placed on the bed of the body of water for receiving the material collected by the collection tool 132.

For this purpose, each excavator vehicle 30 is connected to the receiving means 134 by way of a flexible hose that is analogous 40 to the flexible hose in FIG. 1.

By way of a variant, the device comprises a plurality of vehicles 30, each connected to the separator 42 or to the receiving means 134 through a flexible hose analogous to the flexible hose 40 in FIG. 1.

Figure 4:
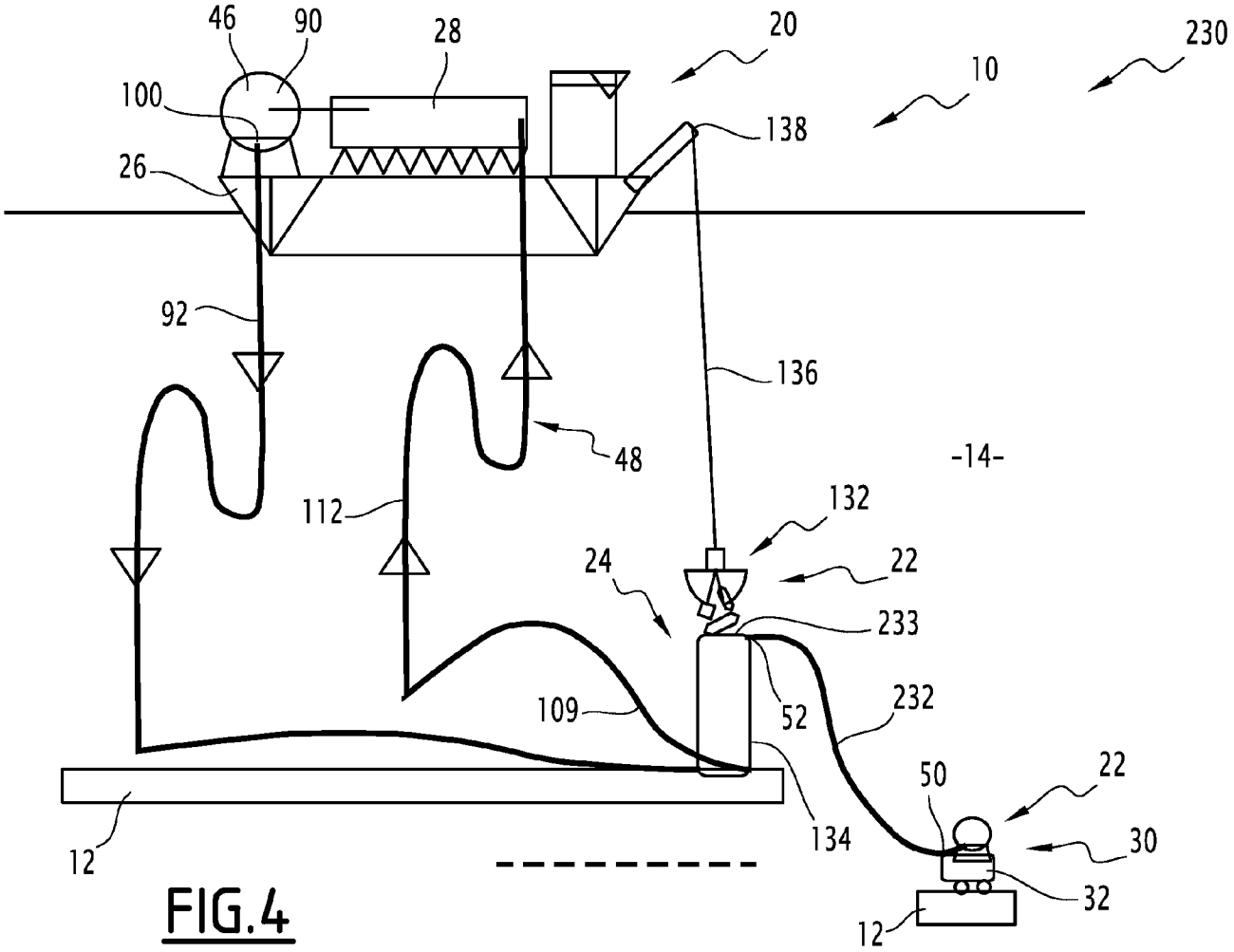
FIG. 4 is a view similar to that in FIG. 1 of a fourth device according to the invention.
Figure 5:
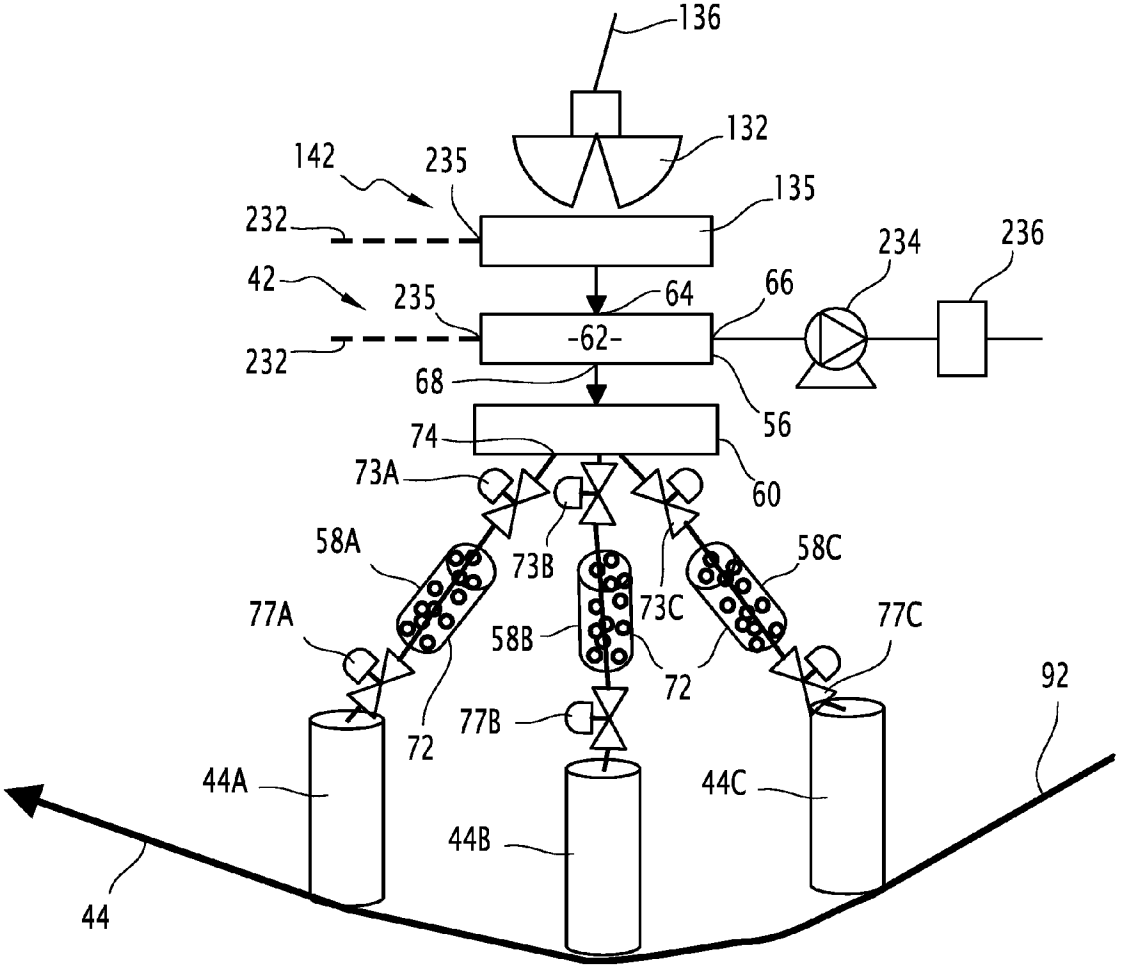
FIG. 5 is an enlarged schematic view of the collection assembly and the separator of the device in FIG. 4.
Figure 6:
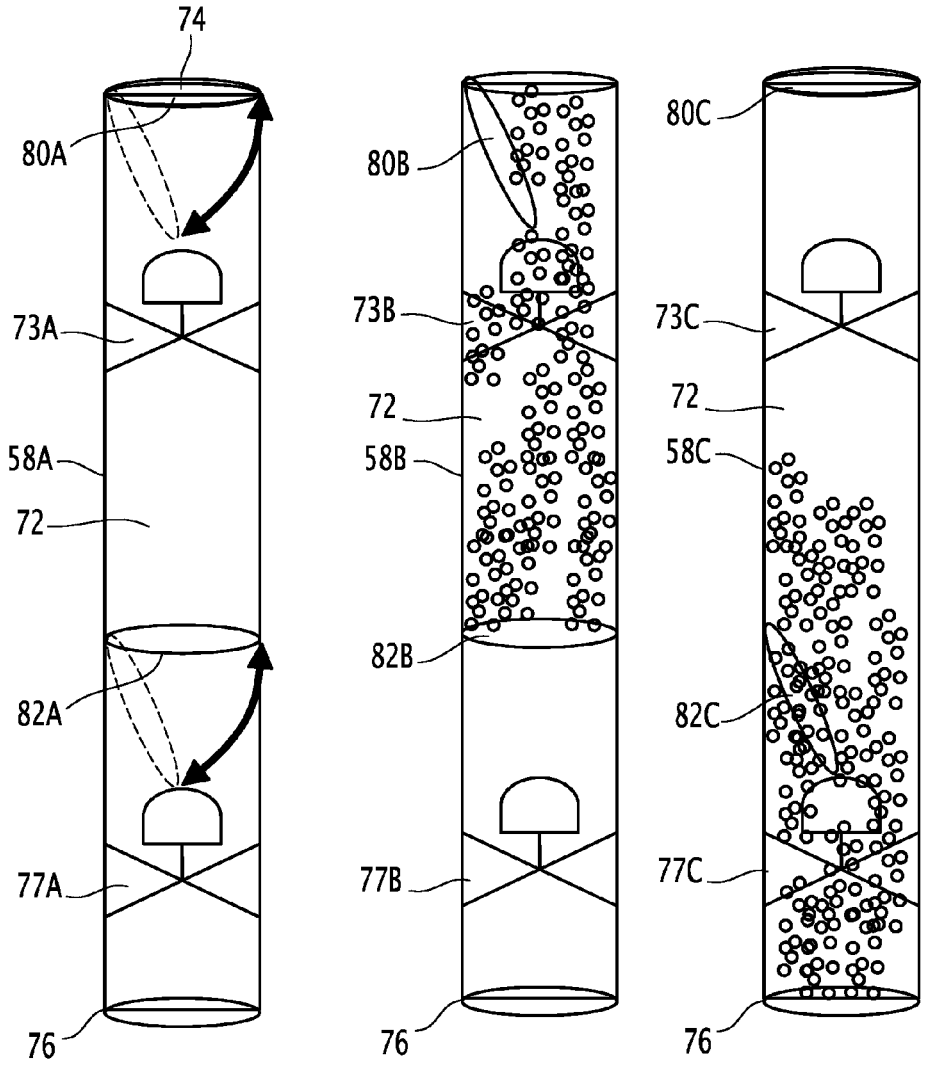
FIG. 6 is a view of the tanks downstream of the separator in FIG. 5.

A fourth device 230 according to the invention is illustrated in FIGS. 4 to 6.

The fourth device 230 differs from the first device 10 and the second device 130 in that the pump 90 is carried by the surface facility 26. The pump 90 is connected downstream to the lower end of the riser 48 by means of a tapping pipeline 92 extending through the body of water 14.

This tapping pipeline is then a pipe for injection of pressurised water.

Advantageously, the intake inlet of the pump 90 is connected to the means for unloading 28 of the solid material on the surface facility 26, for example formed by a surface separator, in order to use the water coming from the unloading means 28.

In this example, the collection assembly 22 includes both at least one excavator vehicle 30 mounted so as to be mobile on the bed 12 of the body of water 14, as well as a collection tool 132 that may be actuated from the surface 16 of the body of water 14. The collection assembly 22 further comprises the receiving means 134 for receiving the material collected by the excavator vehicle 30 and the collection tool 132.

As previously described above, the excavator vehicle 30 includes the autonomous means of propulsion (not shown) to enable it to move in an autonomous manner on the bed 12 of the body of water 14. It comprises the means 32 for collection and removal of the material, which are capable of digging, scraping, and/or of drilling the material constituting the bed 12 of the body of water and transporting it up to the conveyor assembly 24. An example of the excavator vehicle is described in the French patent application FR-A-2 467 283.

Each excavator vehicle 30 is connected to the receiving means 134 via a flexible hose 232.

As depicted in FIGS. 4 and 5, the receiving means 134 comprise a support, a grinder/crusher 135, a funnel (not shown) for receiving the material collected by the tool 132 and a connecting flange 235 for connecting the flexible hose 232.

The flexible hose 232 is analogous to the flexible hose 40 described for the device 10 in FIG. 1. It has a downstream end 52 connected on to the receiving means 134. It is connected either upstream from the grinder/crusher 135 in order to allow for the solid material coming from the flexible hose 232 to pass through the grinder/crusher 135, or downstream of the grinder/crusher, for example on the separator so as to open out directly into the upstream tank 56.

The collection tool 132 may be actuated from the surface 16 of the body of water 14. It is connected to the surface by means of an actuator cable 136 controlled by a crane 138 carried by the surface facility 22.

The collection tool 132 is for example a collection gripper and/or a pneumatic drill integrally attached to the gripper, or even a pneumatic drill deployed from the surface facility 22 by an additional cable for deployment and movement.

According to one embodiment of the invention, the conveyor assembly 24 includes a separator 42 provided with an upstream separation tank 56 for separating a collection stream received from the grinder/crusher 135 and provided with downstream tanks 58A, 58B and 58C for discharging of a stream with high content of solid material produced in the separation tank 56. The separator 42 includes a distributor with valves 60 interposed between the upstream tank 56 and the downstream tanks 58A, 58B, 58C.

The upstream tank 56 forms a funnel for separation of the collection stream received from the grinder/crusher 135. It defines an internal space 62 for separation. The internal space 62 opens out upstream by way of an upper opening 64 for injection of the collection stream, and advantageously by way of an upper outlet 66 for discharging a liquid stream for a solid material.

The internal space 62 in addition opens downwards to the bottom by way of an outlet 68 for draining a stream with high content of solid material towards the distributor 60. The upper outlet 66 for discharging the stream with low content of solid material is situated above the lower outlet 68 for draining the stream with high content of solid material.

In a variant represented in FIG. 5, the upper outlet 66 for discharging the liquid stream with low content of solid material is connected to a pump 234 provided at the outlet with a filter 236 to be used for removing the solid particles present in the liquid stream with low content of solid material. The presence of the filter 236 makes it possible to release into the body of water 14 a liquid that is substantially free of solid material.

The injection inlet 64 is connected to the outlet of the grinder/crusher 135. The draining outlet 68 is located below the injection inlet 64. It advantageously opens out vertically into the bottom of the tank 56. Thus, the collection stream containing liquid and a solid material in divided form is suitable for being separated in the internal space 62 so as to form a stream with high content of solid material, meant to be discharged through the lower draining outlet 68, and a stream with low content of solid material meant to be discharged through the upper discharge outlet 66.

The downstream tanks 58A, 58B, 58C each delineate a receiving space 72 for receiving the stream with high content of solid material. The space 72 is connected upstream to the distributor 60 by way of an upstream inlet 74 and is connected downstream to a respective upstream section 44A, 44B, 44C of the intermediate pipe 44 by way of a discharge outlet 76.

The respective upstream sections 44A, 44B, 44C are advantageously inclined relative to the vertical so as to promote the flow of the solid material driven by gravitational forces.

In this example, the distributor 60 may include a rotary drum. By way of a variant, the rotary drum may be excluded from it.

The distributor comprises, for each downstream tank 58A, 58B, 58C, an upstream isolation valve 73A, 73B, 73C disposed between the upper tank 56 and the downstream tank 58A, 58B, 58C, and a downstream isolation valve 77A, 77B, 77C interposed between the receiving space 72, and each upstream section 44A, 44B, 44C of the pipe 44.

The distributor 60 is capable of controlling the selective discharge of the stream with high content of solid material to one of the tanks 58A, 58B, 58C by preventing the solid material from being conveyed to the other tanks 58A, 58B, 58C.

The upstream isolation valves 73A, 73B, 73C and the downstream isolation valves 77A, 77B, 77C, of the downstream tanks 58A, 58B, 58C are used to selectively isolate the downstream tanks 58A, 58B, 58C.

Thus, the distributor 60 is controllable between a first distribution configuration and at least a second distribution configuration.

In the first distribution configuration, the internal space 62 of the upstream tank 56 is connected hydraulically to the internal space 72 of a first tank 58A. The internal space 62 of the upstream tank 56 and the internal space 72 of each other tank 58B, 58C are separated by a valve 73B, 73C that prevents the passage of the stream with high content of solid material.

In each second configuration, the internal space 62 of the upstream tank 56 is hydraulically connected to the internal space 72 of a second tank 58B, and the internal space 62 of the upstream tank 56 is isolated from the internal space 72 of the first downstream tank 58A by the valve 73A.

In one example of an embodiment, the downstream tanks 58A, 58B, 58C are made up of sections of rigid tubing that are sufficient in length for regulating the gravitationally driven fall of the material and thereby preventing the accumulation of an excessive quantity of material.

Each downstream tank 58A, 58B, 58C advantageously extends along an axis that is inclined relative to a vertical axis.

In a particular embodiment, represented in FIG. 6, upstream protection clapper valves 80A, 80B and 80C are disposed respectively upstream of the Isolation valves 73A, 73B and 73C in order to prevent the agglomeration of material on the valves 73A, 73B, 73C during the phases of distribution.

Similarly, the downstream protection clapper valves 82A, 82B, 82C are disposed respectively upstream of the downstream isolation valves 77A, 77B, 77C in order to prevent any agglomeration of material on these valves during the phases of filling of the downstream tanks 58A, 58B, 58C.

Each clapper valve 80A to 80C; 82A to 82C is thus controllable between a transverse configuration for blocking off the passage of solid material and a longitudinal configuration for allowing the passage of the solid material.

In the blocking configuration of the clapper valve 80A to 80C; 82A to 82C, the valve 73A to 73C; 77A to 77C, respectively located downstream of the clapper valve 80A may be manoeuvred to bring about its opening, before the opening of the clapper valve 80A to 80C, 82A to 82C, without its being blocked by the solid material.

The operation of the second device 230 according to the invention will now be described.

Initially the extraction device 230 is set up in place as previously described above. The setting in place of the extraction device 230 will thus not be described in more detail here below.

Unlike the device 10, the pump 90 is maintained on the surface facility 26. The delivery outlet 100 is connected to the lower end of the riser 48 by means of the tapping pipeline 92 immersed in the body of water 14.

When the solid material is to be collected from the bed 12 of the body of water 14, the collection assembly 22 is activated. The operation of the collection means 32, 132 is then started in order to collect the rocks and/or sediments from the bed 12 of the body of water 14. This makes it possible to carry out earth moving and excavation operations or the recovery of solid material on the bed 12.

The solid material collected by the collection tool 132 is then fed into the grinder/crusher 135 in order to reduce particle size (granulometry) thereof.

Thereafter, the solid material is conveyed to the separator 42 and enters into the internal space 62 delineated by the upstream tank 56 through the injection inlet 64.

Within the internal space 62, the collection stream is separated by means of sedimentation, into a lower stream with relatively high content of solid material, collected in the bottom of the tank 56 and an upper stream with relatively low content of solid material, formed in the upper portion of the tank 56.

The stream with low content of solid material advantageously contains particles having a size of less than 1 mm. In this configuration, it is discharged through the opening 66, and is then passed into the pump 234 and into the filter 236 so as to form a liquid that is released into the body of water substantially free of particles.

The distributor 60 is then passed into its first configuration for the filling of the first tank 58A.

To this end, in the variant in FIG. 6, the clapper valve 80A is first of all kept closed. The valve 73A is then manoeuvred so as to unblock the passage towards the internal space 72.

The clapper valve 80A is thereafter placed in its 'pass through' configuration allowing the passage of solid material, through the clapper valve 80A and the valve 73A.

In this configuration, the downstream clapper valve 82A is kept blocked off. The downstream valve 77A, present at the discharge outlet 76 of the first tank 58A is also closed. The solid material accumulates in the internal space 72 of the first tank 58A.

In this first configuration, the internal space 62 of the upstream tank and the interior space 72 of the first downstream tank 58A are maintained at equivalent pressure. This pressure is for example equal to the surrounding hydrostatic pressure (for example 170 bars).

Then, when the interior space 72 of the first downstream tank 58A is substantially filled with solid material, the upstream clapper valve 80A is first of all closed. Then the upstream valve 73A is blocked off.

The upstream clapper valve 80B of the second downstream tank 58B is first of all kept blocked off, and the upstream valve 73B of the second tank 58B is opened so as to switch the distributor 60 into its second configuration.

The upstream clapper valve 80B is then opened and the stream of solid material continuously collected in the upstream tank 56 is discharged into the second downstream tank 58B.

The passage of the solid material into the first tank 58A is prevented by the upstream clapper valve 80A and the upstream valve 73A of the first downstream tank 58A.

Simultaneously, the downstream clapper valve 82A is closed. The downstream isolation valve 77A located at the downstream outlet 76 for discharging fluid from the first downstream tank 58A is then opened. The downstream clapper valve 82A is subsequently opened.

The pressure in the interior space 72 of the first downstream tank 58A is then brought to a value substantially equal to the pressure in the pipe 44, for example 150 bar. The solid material present in the internal space 72 of the first tank 58A is free to flow driven by gravitational forces through the upstream section 44A of the intermediate pipe 44.

The previous steps of switching of the distributor 60 are then repeated throughout the entire process of extraction of the solid material.

In the event of the distributor 60 not having any drum, the tanks 58A, 58B and 58C may be filled simultaneously or one after the other so as to still obtain a continuous stream in the pipe 44.

The pump 90 is activated in continuous mode in advance. The pressurised water collected advantageously in the means 28 for unloading of the solid material is pumped through the pump 90, the delivery outlet 100 and the tapping pipeline 92.

This pressurised water is then injected into the lower section 109 of the riser 48 in order to move up through the riser 48. The injection of pressurised water causes the continuous driving of the stream with high content of solid material from each tank 58A, 58B, 58C, through the intermediate pipe 44, the lower section 109 of the riser 112, and then through the internal passage 120 of the riser 112. The stream with high content of solid material then moves up to the surface facility 26 to be collected in the unloading means 28.

The pressure of water injection into the riser 48 depends in particular on the internal diameter of the riser 48, the size of particles, the density of the material, the depth of water, the rate of flow of the mixture formed by the particles and water. As a result, the injected pressure is calculated by the person skilled in the art based on these parameters. It is generally higher by at least 50 bars than the measurable hydrostatic pressure on the seabed. By way of an example, when the depth is 1700 m, the hydrostatic pressure on the seabed is approximately 170 bars, and the injected pressure is greater than 220 bars.

By way of a variant, the riser 48 has a configuration similar to that described in the French patent application FR 2 929 638 filed by the Applicant. It then has an intermediate section stretched vertically between an anchoring point 12 in the bed of the body of water 14 and a submerged intermediary buoy (not shown). It also has an upper section that is shaped like a 'U', 'J', or 'S' for its connection to the surface facility 26. The upper section allows for the rapid disconnection from the surface facility 26, where this is necessary and the effective absorption of movements caused by waves and/or the swell.

In an advantageous variant, the pipe 92 also has a configuration that is analogous to that described in the document FR 2 929 638, with a vertical intermediate section stretched between an anchoring point 12 on the bed of the body of water 14 and a submerged buoy. The pipe 92 has an upper section that is shaped like a 'U', 'J', or 'S'.

In one variant, the anchoring point of the riser 48 is formed directly by the receiving means 134. In this case, the funnel for receiving the solid material is offset relative to the axis of the riser 48 in order to allow the deposit of solid material in the receiving means 134 without damaging the riser 48.

Figure 7:
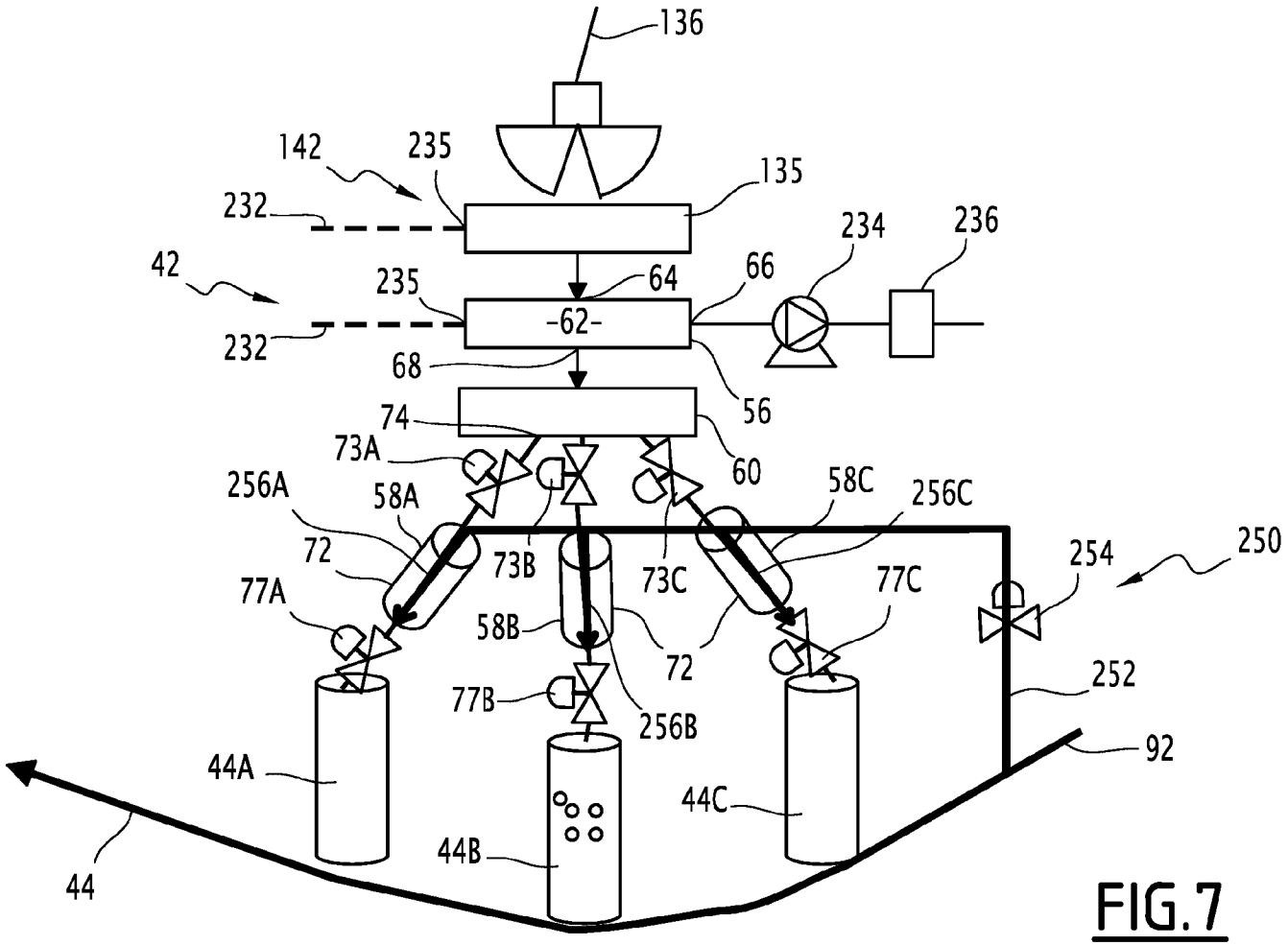
FIG. 7 is a view similar to that in FIG. 5 of a fifth device according to the invention.

FIG. 7 illustrates a variant of the device 230 in FIG. 5. This device includes a system 250 for bypassing pressurised water connected to the downstream tanks 58A, 58B, 58C.

The water bypass system 250 includes a bypass pipe 252, tapped on to the tapping pipeline 92, upstream of each upstream section 44A, 44B, 44C of the pipe 44, an isolation valve 254 and, for each downstream tank 58A, 58B, 58C, a bypass 256A, 256B, 256C, which connects the pipe 252 to the intermediate space 72 of each downstream tank 58A, 58B, 58C, upstream of the downstream clapper valve 82A, 82B, 82C and the downstream valve 77A, 77B, 77C.

Thus, the pressurised water, coming from the pump 90 through the tapping pipeline 92 may be introduced into each downstream tank 58A, 58B, 58C so as to bring about the cleaning, or even the unclogging of the tank 58A, 58B, 58C and of the valve 77A, 77B, 77C.

To this end, the isolation valve 254 is open for bringing the pressurised water from the pipe 92 and which is pumped into each of the tanks 58A, 58B, 58C.

What is claimed is:

1. A device for extracting solid material on the bed of a body of water, of the type comprising:

an assembly for collecting material on the bed of the body of water;

a riser for lifting the solid material up towards a surface facility;

a pump capable of pumping a liquid, designed for lifting the solid material collected by the collection assembly in the riser towards the surface facility, the pump having an intake inlet and a delivery outlet;

wherein the device comprises:

a separator, to be used for processing the collection stream received from the collection assembly in order to form a stream having a high content of solid material and a stream having a low content of solid material, the separator including an injection inlet for injecting the collection stream, and at least one lower discharge outlet for discharging the stream with high content of solid material;

an upstream flexible hose connecting the collection assembly to the separator; and an intermediate pipe connecting the or each discharge outlet for discharging the stream with high content of solid material and a lower section of the riser, the delivery outlet of the pump being tapped into the lower section of the riser or into the intermediate pipe.

2. A device according to claim 1, wherein the separator comprises a support placed on the bed of the body of water or carried by the riser.

3. A device according to claim 1, wherein the separator comprises an upstream separation tank for separating the collection stream and at least one downstream discharge tank for discharging the stream with high content of solid material, the separator further comprising a distributor interposed between the upstream receiving tank and the downstream discharge tank, the distributor being adapted to selectively allow the passage of the stream with high content of solid material from the upstream separation tank to the downstream discharge tank.

4. A device according to claim 3, wherein the distributor comprises, each of the downstream tanks, one upstream isolation valve and one downstream isolation valve, the distributor further comprising a controllable clapper valve disposed upstream of each isolation valve in order to prevent the passage of the stream with high content of solid material towards the isolation valve before the opening of the isolation valve.

5. A device according to claim 3, further comprising a system for bypassing pressurised water connected to each tank and isolated by a valve.

6. A device according to claim 3, wherein the separator comprises at least two downstream discharge tanks, the distributor being controllable between a first configuration for the passage of the stream with high content of solid material from the upstream separation tank towards a first downstream discharge tank and for isolation of the second downstream discharge tank, and a second configuration for the passage of the stream with high content of solid material from the separation tank towards the second downstream discharge tank, and for isolation of the first downstream discharge tank.

7. A device according to claim 3, wherein the distributor includes a rotary drum.

8. A device according to claim 1, wherein the collection assembly comprises at least one excavator vehicle intended to be brought into contact with the bed of the body of water so as to collect and remove the solid material on the bed of the body of water.

9. A device according to claim 1, wherein the collection assembly comprises a holding support for collecting the material intended to be placed on the bed of the body of water and means for collection deployable from the surface independently of the holding support.

10. A device according to claim 1, wherein the collection assembly includes a grinder/crusher, meant to be used for reducing the particle size of the collection stream received from the collection assembly, the grinder/crusher being mounted upstream from the separator.

11. A device according to claim 1, further comprising a surface facility, advantageously floating on the body of water, the riser opening into the surface installation.

12. A device according to claim 11, wherein the pump is carried by the surface installation, the delivery outlet of the pump being tapped into the riser or into the intermediate pipe by means of a tapping pipeline extending through the body of water.

13. A device according to claim 1, wherein the intake inlet of the pump is adapted to be connected to the body of water, the device including a filtration assembly interposed between the body of water and the intake inlet.

14. A method for extraction of solid material on the bed of a body of water, comprising the following steps:

providing a device according to claim 1;

collection of collecting the material on the bed of the body of water by means of the collection assembly;

separating the collection stream received from the collection assembly in the separator in order to produce a stream with high content of solid material;

discharging of the stream with high content of solid material through the lower discharge outlet; and activating the pump and injecting a liquid into a lower section of the riser or into the intermediate pipe for driving the stream with high content of solid material through the riser towards a surface facility.

* * * * *